US009901164B2

(12) United States Patent
Houston et al.

(10) Patent No.: US 9,901,164 B2
(45) Date of Patent: Feb. 27, 2018

(54) METHOD OF USING A CONVERTIBLE DIAPER-CHANGING BAG

(71) Applicant: Anna and Eve, LLC, Placitas, NM (US)

(72) Inventors: Robert Houston, Placitas, NM (US); Anna Jones, Placitas, NM (US)

(73) Assignee: ANNA and Eve, LLC, Placitas, NM (US)

( * ) Notice: Subject to any disclaimer, the term of this patent is extended or adjusted under 35 U.S.C. 154(b) by 98 days.

(21) Appl. No.: 15/153,039

(22) Filed: May 12, 2016

(65) Prior Publication Data

US 2016/0255943 A1 Sep. 8, 2016

Related U.S. Application Data

(63) Continuation of application No. 14/496,853, filed on Sep. 25, 2014, now abandoned.

(60) Provisional application No. 61/882,071, filed on Sep. 25, 2013.

(51) Int. Cl.

| | |
|---|---|
| ***A45F 4/02*** | (2006.01) |
| ***A45C 9/00*** | (2006.01) |
| ***A47D 5/00*** | (2006.01) |
| ***A45C 7/00*** | (2006.01) |
| ***A45F 3/02*** | (2006.01) |

(52) U.S. Cl.

CPC ..... *A45F 4/02* (2013.01); *A45C 7/0095* (2013.01); *A45C 9/00* (2013.01); *A45F 3/02* (2013.01); *A47D 5/006* (2013.01)

(58) Field of Classification Search

CPC .... A45C 2007/0004; A45C 2007/0009; A45C 2007/013; A45C 7/00; A45C 13/30; A45C 7/0095; A45C 9/00; A45F 3/02; A45F 4/00; A45F 4/02; A45F 4/06; A45F 4/08; A45D 5/006; A45D 15/003; A45D 9/005; A45D 7/002; A47G 23/0608

USPC ..... 224/156, 577–580; 229/199, 117.04; 220/646, 650–651; 5/99.1, 98.1, 655; 190/2; 180/33, 27

See application file for complete search history.

(56) References Cited

U.S. PATENT DOCUMENTS

| | | | | |
|---|---|---|---|---|
| 2,502,486 A * | 4/1950 | Savrin | A45C 9/00 190/1 |
| 4,198,718 A * | 4/1980 | Ballard | A01K 1/0353 119/499 |
| 4,999,863 A * | 3/1991 | Kane | A45C 9/00 190/2 |
| 5,813,558 A * | 9/1998 | Burke | A45C 9/00 150/112 |

(Continued)

*Primary Examiner* — Scott McNurlen
(74) *Attorney, Agent, or Firm* — Richard Patent Law P.C.

(57) ABSTRACT

A method of using a convertible includes providing a convertible bag that includes a changing surface including a first tray panel and a second tray panel; first and second panel side walls extending perpendicular from the first and second tray panels, respectively; a shoulder strap including a first strap end and a second strap end, wherein each of the first and second strap ends is removably attached to the bag; and a plurality of connection points for removably attaching the first and second strap ends to the bag. The convertible bag moves between a closed position and an open position. In the closed position, the first panel and the second panel are parallel. In the open position, the first and second tray panels are within a plane.

5 Claims, 7 Drawing Sheets

(56) References Cited

U.S. PATENT DOCUMENTS

| | | | | |
|---|---|---|---|---|
| 6,213,304 | B1 * | 4/2001 | Juliussen | A45C 3/00 206/581 |
| 2005/0210594 | A1 * | 9/2005 | Pistiolis | A45C 9/00 5/655 |
| 2006/0150323 | A1 * | 7/2006 | Daeseleire | A47C 21/026 5/93.1 |

* cited by examiner

METHOD OF USING A CONVERTIBLE DIAPER-CHANGING BAG

CROSS-REFERENCE TO RELATED APPLICATIONS

This application incorporates by reference and claims the benefit of priority to U.S. application Ser. No. 14/496,853 filed Sep. 25, 2014, which incorporates by reference and claims the benefit of priority to U.S. Provisional Application No. 61/882,071 filed on Sep. 25, 2013.

BACKGROUND OF THE INVENTION

The present subject matter relates generally to a diaper bag that can convert into a diaper changing surface.

Changing a baby's diaper at home is the ideal place to change a diaper, as most parents own a diaper changing table. Conventional diaper changing tables include shallow side walls to prevent the baby from rolling off the table, but the side walls are not so high as to prevent or encumber an adult from accessing the baby to change its diaper. The tables are typically designed to receive a foam pad for the comfort of the baby. The foam pads are often contoured such that the sides of the pad are higher than center of the pad to prevent the baby from rolling off the side of the pad and/or table. An advantage of diaper changing tables at home is that they are clean, personal, and safe. However, changing tables are not portable. In addition, changing tables fail to hold or contain many of the items needed for changing a baby, such as diapers, ointments, powders, etc. Instead, such supplies must be stored on or in the changing table itself.

Changing a baby's diaper outside of the home in public places can be inconvenient at best, and a hassle at worst. Restaurants and public bathrooms may be equipped with a changing surface that folds down from a wall in a bathroom stall. Such changing tables are hard plastic and used by any number of babies. As a result, such changing tables are not clean, comfortable, or personal. Additionally, many restaurants and other public places fail to provide a folding down changing table. In such case, adults must change the baby on the floor, the sink counter, or in his or her lap, all options being inconvenient, unhygienic, and unsafe.

Portable changing mats or surfaces are available, however such mats are typically flat pieces of fabric that may be rolled or folded and do not offer much by way of comfort for the baby. In addition, a baby may roll on and off the mat with ease, which is a safety hazard.

Conventional diaper bags are designed for easy transport of, and access to, the many products one needs to change a baby's diaper, such as diapers, wipes, ointments, etc. However, conventional diaper bags are meant to only store useful items for changing a baby's diaper, including a changing pad that may be stored in the bag.

In addition, typically an adult must duplicate all of the products on or in the changing table into the diaper bag. Alternatively, an adult must pack all of the items in the changing table into the diaper bag each time the adult leaves the house with the baby. Often adults may end up missing an item needed for a diaper change because he or she forgot to pack every single item in the changing table.

As a result, a diaper changing surface and diaper changing bag is needed to efficiently change a baby's diaper away from home.

BRIEF SUMMARY OF THE INVENTION

The present disclosure provides a diaper bag that may convert into a baby changing surface. Various examples of the bags are provided herein.

The present disclosure provides a convertible bag that may transform from a closed form into an open form that is suitable as a baby changing surface. When in the open form, the bag expands to form an elongated tray with elevated side walls. Attached to the side walls is at least one compartment that may flip from being stored inside the bag in the closed form to hanging along the outer surface of the side walls when the bag is in the open form. The interior of the bag includes a padded surface that not only provides structural integrity, but also a comfortable surface for a baby to lie on during a diaper change.

The bag is either a semi-soft case, a hard sided case, or combination thereof. The bag is small enough and light enough to be comfortably carried over the shoulder of the user. When opened, the bag forms an elongated tray that is wide and long enough to contain an infant laying down, as well as small enough to lay across the lap of an adult. The side walls extending from the tray are typically 2 to 6 inches in height. When the bag is open, the tray will not open beyond the flat plane due to the tray panels being rigid. In an example, an extension panel is included on or in one of the tray panels such that the extension panel may slide or swing open over the flexible midline of the tray to provide greater structural integrity when the bag is in the open position. As such, when the extension panel is extended over the midline of the tray, and a baby is placed in the tray, the tray does not buckle at the midline and fold. Instead, the extension panel prevents the tray from folding or buckling when a baby is in the tray. When the bag is in the closed form, a zipper that runs along a portion of a top edge of the side panels fastens the side panels together, thereby folding the two tray panels towards each other such that the tray panels move from a coplanar position into a parallel position. Alternatively, the side panels may be fastened by clasps, snaps, buttons, hook and loop fastening system, or any other appropriate fastening mechanism.

The center sections of the side panels along the length of the tray may include gussets that are not rigid and allow the two tray panels to fold toward and away from each other when converting from the open form and closed form. The side panels along the length of the tray may include two rigid flaps that may extend over the gussets to provide structural integrity to the side walls such that a baby does not roll off the tray. For example, the rigid flap may extend from a first portion of the side wall across the gusset to a second portion of the side wall to form a solid bridge and increase stability. It is contemplated that any number of rigid flaps may be used to stabilize the position of the tray in the open position. For example, a single strap could be used along one side wall or four straps could be used (e.g., two along the inside and outside of each side wall).

The bag may include hanging compartments that are attached along the top edge of the side wall. When the bag is in the open form, the compartments may be flipped to the outside of the side wall and hang down from the top edge of the side wall. The compartments include openings that are easily accessible by the user during a diaper change. Yet because the compartments flip to hang outside the tray, the compartments do not encumber the user or the baby during a diaper change. After a diaper change and the baby is removed from the tray, the compartments may flip back to the interior of the side wall and tray, such that when the bag closes into the closed form, the compartments are stored inside the bag. As a result, the items stored in the compartments are maintained in the compartments even when the bag is in the closed form. In other words, the items in the compartments are always organized and not floating around the in the large compartment of the bag.

The bag may include a strap or belt that extends from a first side wall along the length of the tray to the second side wall extending along the length of the tray. The strap may be used to secure the baby to the tray when the bag is in the open form and the baby is placed in the tray. And additional strap may extend from a first portion of an outer surface of a side wall along the length of the tray to a second portion of the outer surface of the side wall along the length of the tray. The additional strap may be used to wrap around the adult such that the bag remains on the user's lap while changing the baby's diaper.

The bag may include rings on the outer surface of the upper corners of the bag in the closed form to which a shoulder strap is connected. The shoulder strap may be designed so that it may be attached around the waste of an adult when the bag is used in the open form to secure the bag in position, for example, on the user's lap. The rings that may hold the shoulder strap may also hold a shorter strap to attach to the bag to a stroller. The bag may also include handles allowing a user to carry the bag in hand instead of over the shoulder. The outer surface of the bag may also include one or more pockets or compartments for storing any number of items including, but not limited to, a bottle, ointments, baby wipes, etc.

In an embodiment, the convertible bag includes a changing surface including a first tray panel, a second tray panel, and a center tray panel, wherein the center tray panel connects the first tray panel to the second tray panel. The bag includes a first panel side wall extending perpendicular from the first panel along the perimeter of the first tray panel, wherein the first panel side wall includes a first top edge, a second panel side wall extending perpendicular from the second panel along the perimeter of the of the second tray panel, wherein the second panel side wall includes a second top edge, and a center panel side wall extending perpendicular from the center tray panel along the perimeter of the center tray panel. When the bag is in a closed form, the first tray panel and second tray panel are parallel, the first tray panel and second tray panel are perpendicular to the center tray panel, at least a portion of the first top edge of the first panel side wall is connected to at least a portion of the second top edge of the second panel side wall. When the bag is in an open form, the first tray panel, second tray panel, and center tray panel are within a plane perpendicular to the first panel side wall and the second panel side wall.

In an example, the bag may also include a side wall flap that extends from the first panel side wall to the second panel side wall, wherein the side wall flap covers at least a portion of an inner surface of the center panel side wall. The side wall flap may extend from the first panel side wall to the second panel side wall, wherein the side wall flap covers at least a portion of an outer surface of the center panel side wall.

The bag may include a side wall flap including a side wall flap first end and a side wall flap second end, wherein the side wall first end is connected to the first panel side wall. When the bag is in the closed form, the side wall flap second end may be removably attached to the first panel side wall. When the bag is in the open form, the side wall flap second end may be removably attached to the second panel side wall.

In an example, the bag may include a center tray flap, wherein the center tray flap includes a center tray flap first end and a center tray flap second end, wherein the center tray first end is connected to the first tray panel. When the bag is in the closed form, the center tray flap second end may be removably attached to the first tray panel. When the bag is in the open form, the center tray flap second end may be removably attached to the second tray panel.

In another example, when the bag is in the closed form, the center tray flap is stored within a pocket on an outer surface of the first tray panel. In such example, when the bag is in the open form, the center tray flap may slide from the pocket to removeably attach to the second tray panel.

The center panel side wall may include a gusset enabling folding of the center panel side when the bag is in the closed form. In an example, the center panel side wall includes a first material, and the first panel side wall and the second panel side wall includes a second material, wherein the first material is more flexible than the second material.

The bag may also include a strap including a first strap end and a second strap end, wherein the first strap end is removeably connected to the first side wall, wherein the second strap end is removeably attached to the second side wall.

The bag may also include at least one hanging compartment including a compartment top edge, wherein a portion of the compartment top edge is attached to the first panel side wall, wherein the hanging compartment is configured to pivot about the portion of the compartment top edge attached to the first panel side wall. When the bag is in the closed form, the hanging compartment may hang along an internal surface of the first panel side wall. When the bag is in the open form, the hanging compartment may hang along an external surface of the first panel side wall.

An advantage of the present bag is providing a portable diaper bag with a duel purpose of a changing station.

A further advantage of the present bag is providing a changing surface that is personal and hygienic.

Another advantage of the present bag is providing a sturdy and safe changing surface for changing a baby's diaper safely.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
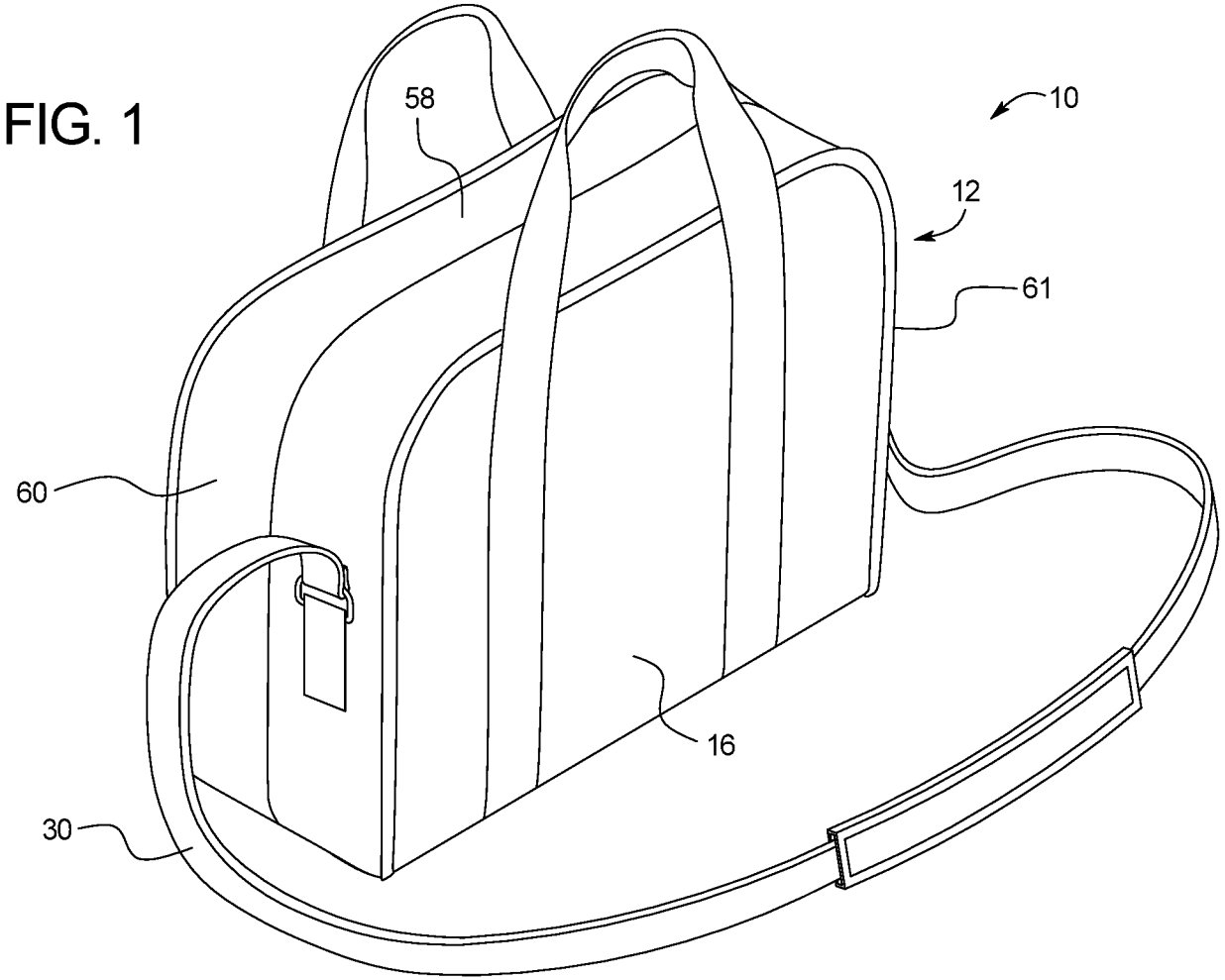
FIG. 1 is a perspective view of an embodiment of the bag disclosed herein in a closed form.
Figure 2:
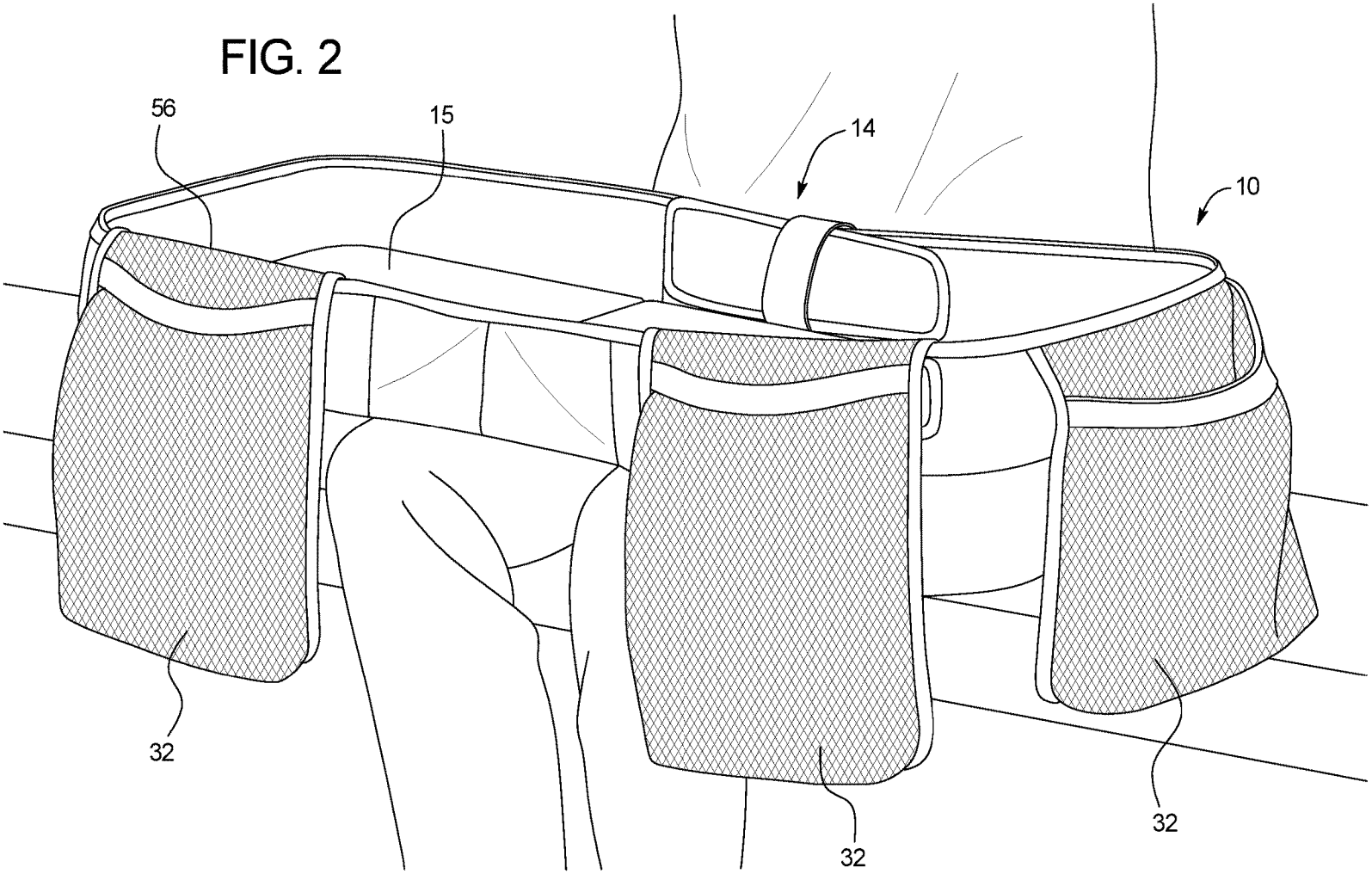
FIG. 2 is a perspective view of an example of the bag in an open form.

The present disclosure provides a convertible bag 10 that transform from a closed form 12 as a diaper bag, as shown in FIG. 1, into an open form 14 as a diaper changing surface, as shown in FIG. 2.

Figure 3:
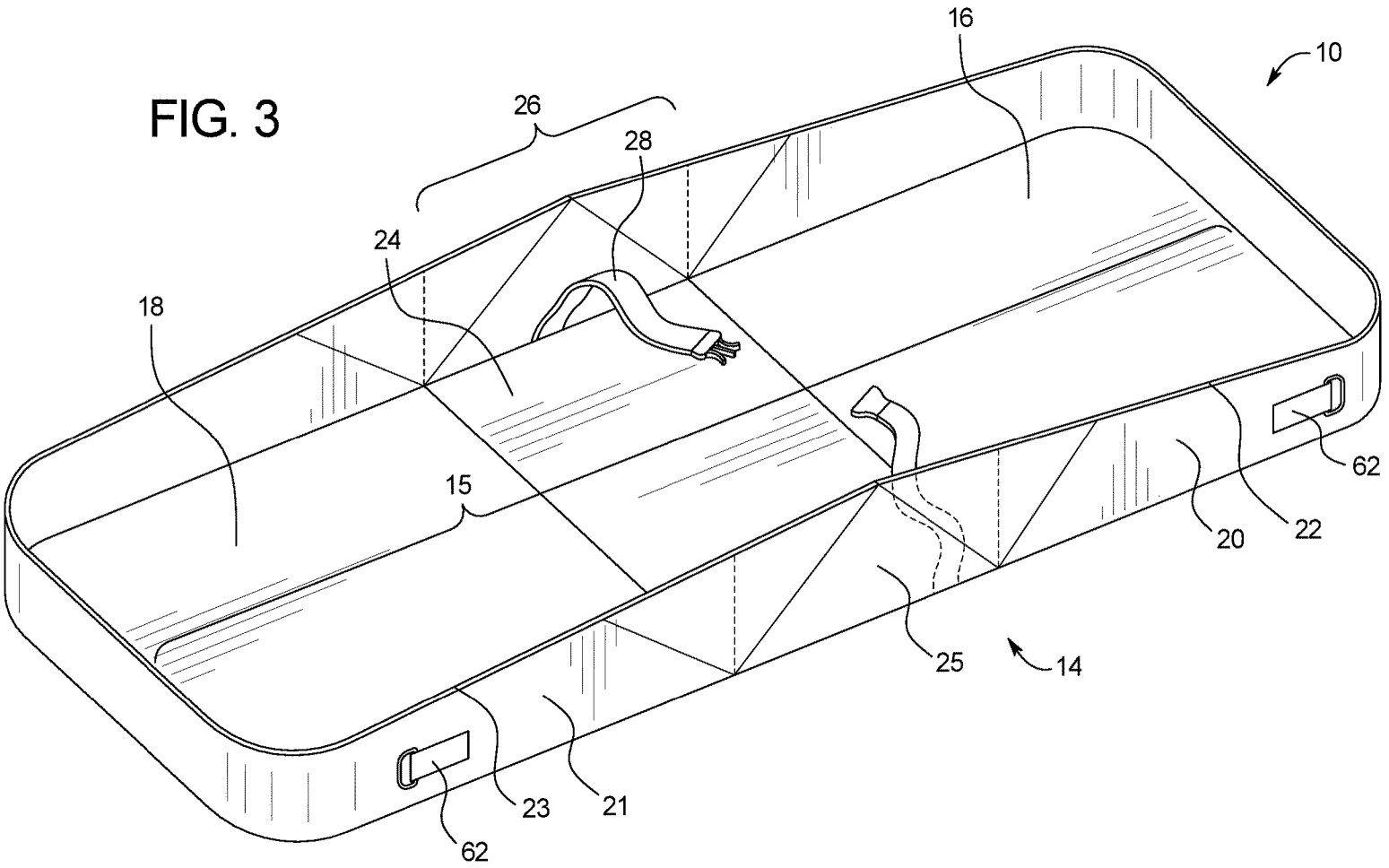
FIG. 3 is a perspective view of an example of a bag in the open form depicting a center strap to secure a baby during a diaper change.

In an embodiment, the convertible bag 10 includes a changing surface 15 including a first tray panel 16, a second tray panel 18, and a center tray panel 24, wherein the center tray panel 24 connects the first tray panel 16 to the second tray panel 18, as shown in FIG. 3. The first tray panel 16, the second tray panel 18, and the center tray panel 24 may be three separate pieces that are fastened together along respective edges. Alternatively, the first tray panel 16, the second tray panel 18, and the center tray panel 24 may be one continuous piece of material. In an example, the changing surface 15 includes only a first tray panel 16 and the second tray panel 18.

The center tray panel 24 may include a first material, and the first tray panel 16 and the second tray panel 18 may include a second material, wherein the first material is more flexible than the second material. Alternatively, the center tray panel 24, the first tray panel 16, and the second tray panel 18 are made of the same material that is rigid, yet padded or cushioned for the comfort of the baby.

The bag 10 includes a first panel side wall 20 extending perpendicular from the first tray panel 16 along the perimeter of the first tray panel 16, wherein the first panel side wall 20 includes a first top edge 22. For example, the first panel side wall 20 extends along three sides of the first tray panel 16, wherein the fourth side of the first tray panel 16 is attached to the center tray panel 24. Similarly, the bag 10 also includes a second panel side wall 21 extending perpendicular from the second tray panel 18 along the perimeter of the of the second tray panel 18, wherein the second panel side wall 21 includes a second top edge 23. Again, the second panel side wall 21 may extend along three sides of the second tray panel 18, wherein the fourth side of the second tray panel 18 is attached to the center tray panel 24. The first panel side wall 20 and the second panel side wall 21 may have a height in the range of 2 inches to 6 inches, including any range between and including 2 inches to 6 inches.

In the open form 14, the first panel side wall 20 and the second panel side wall 21 serve as a physical barrier to prevent a baby from rolling off the changing surface 15 during a diaper change. In the closed form 12, the first panel side wall 20 and the second panel side wall 21 join together along the first top edge 22 and the second top edge 23 to form a top surface 58 of the bag 10 and two side walls 60, as shown in FIG. 1. The first top edge 22 and the second top edge 23 may be joined by a zipper running along the first top edge 22 and the second top edge 23. Of course any suitable fastener may be incorporated to secure at least a portion of the first top edge 22 to at least a portion of the second top edge 23. For example, the fastener may be, but not limited to, a zipper, a hook and loop fastening system, buttons, hooks, clasps, snaps, latches, among others.

The bag 10 also includes a center panel side wall 25 extending perpendicular from the center tray panel 24 along the perimeter of the center tray panel 24. The center panel side wall 25 connects the first panel side wall 20 and the second panel side wall 21, such that the side walls surround the perimeter of the changing surface 15. The center panel side wall 25 may be made of a material that is more flexible than that of the first panel side wall 20 and the second panel side wall 21. As a result, the center panel side wall 25 may be easily folded when the bag 10 transforms from the open form 14 to the closed form 12.

Figure 4:
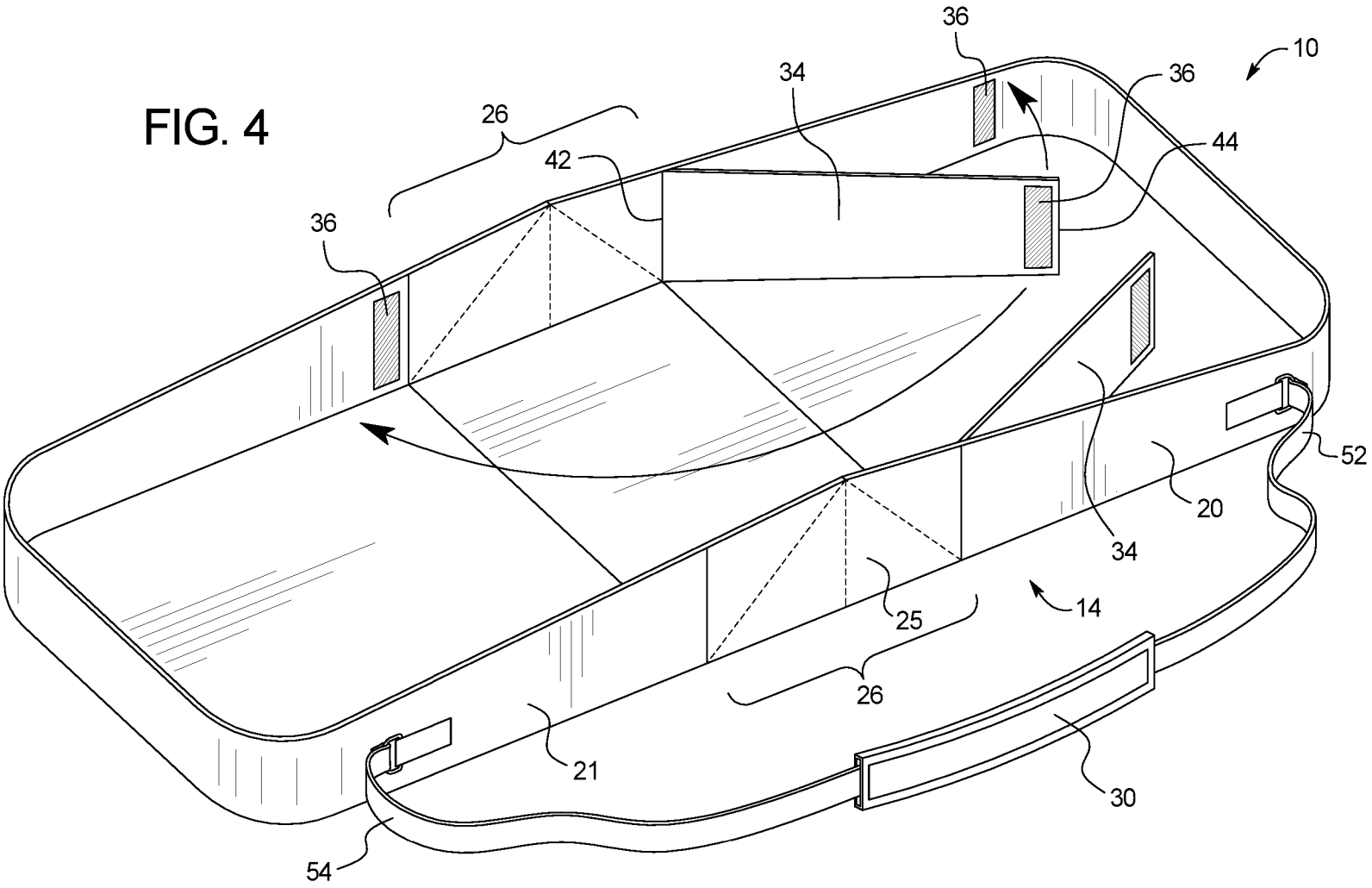
FIG. 4 is a perspective view of another example of a bag including a side wall flap to maintain the structural integrity of the side walls when the bag is in in the open form, wherein the side wall flap extends across an internal surface of the side wall.
Figure 5:
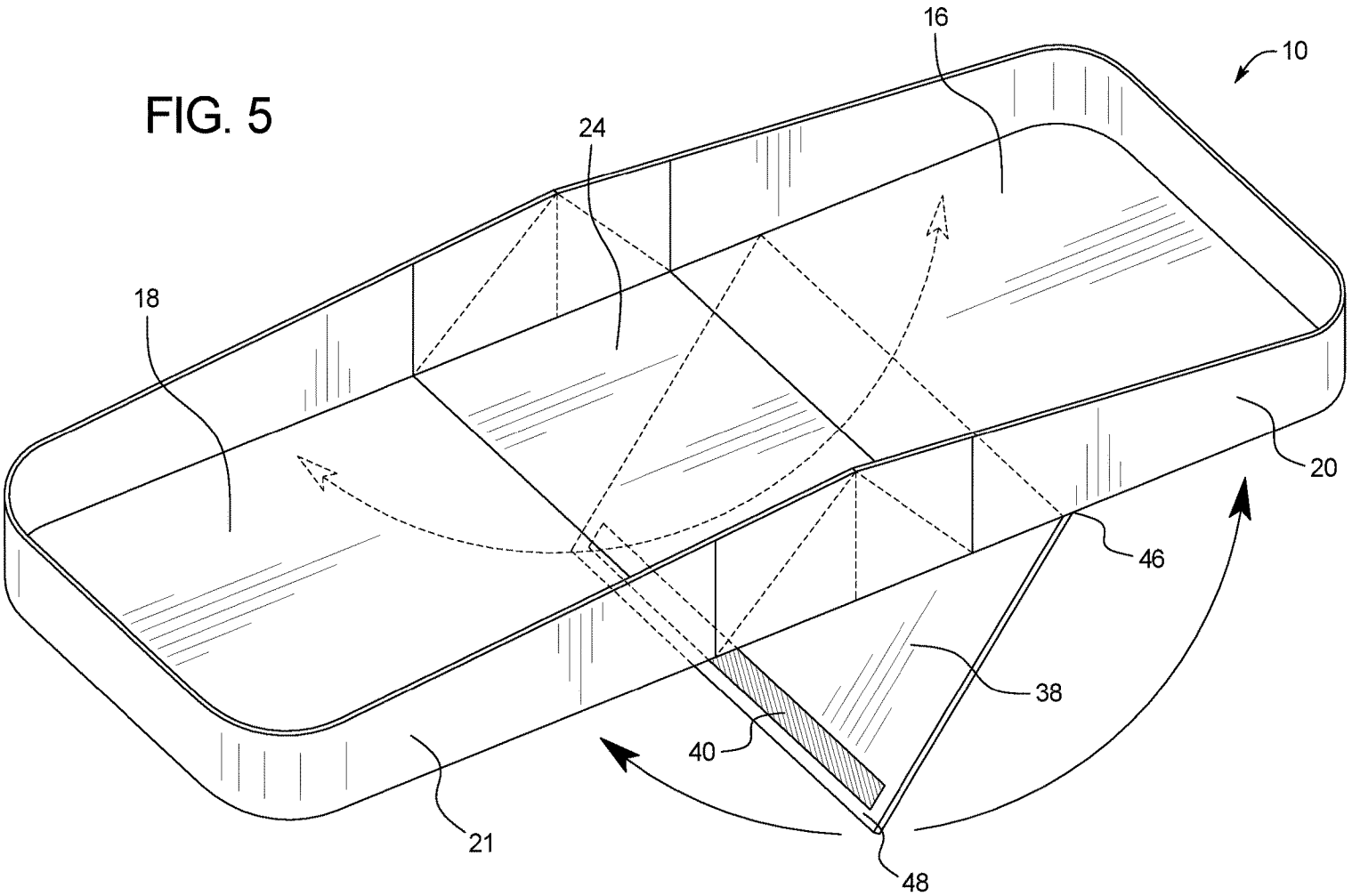
FIG. 5 is a perspective view of an embodiment of the bag in the open form wherein the bag includes a center tray flap to ensure the structural integrity of the center tray panel when the bag is in the open form.

For example, as shown in FIG. 3-5, the center panel side wall 25 may include a gusset 26 enabling folding of the center panel side wall 25 when the bag 10 is in the closed form 12. Of course, the center panel side wall 25 may include any suitable structure that enables folding and extending of the center panel side wall as the bag 10 transform from the closed form 12 to the open form 14. For example, the center panel side wall 25 may include pleats, elastic, gathers, extendable belts, among other items or mechanisms.

As shown in FIG. 1, when the bag is in a closed form 12, the first tray panel 16 and the second tray panel 18 are parallel forming the sides of the bag 10 in the closed form 12. In addition, the first tray panel 16 and the second tray panel 18 are perpendicular to the center tray panel 24, wherein the center tray panel 24 forms a bottom surface of the bag 10 in the closed form 12. In addition, in the closed form 12, at least a portion of the first top edge 22 of the first panel side wall 20 is connected to at least a portion of the second top edge 23 of the second panel side wall 21. The connection of the first top edge 22 and the second top edge 23 form a top surface and two side surfaces of the bag 10 in the closed form 12.

When the bag 10 is in an open form 14, as shown in FIGS. 2-5, the first tray panel 16, second tray panel 18, and center tray panel 24 are within a plane perpendicular to the first panel side wall 20 and the second panel side wall 21. A top surface of the changing surface 15 may be contoured such that the sides along the length of the changing surface 15 are higher than the center of the changing surface 15 such that a baby is further prevented from rolling off the changing surface 15.

Figure 7:
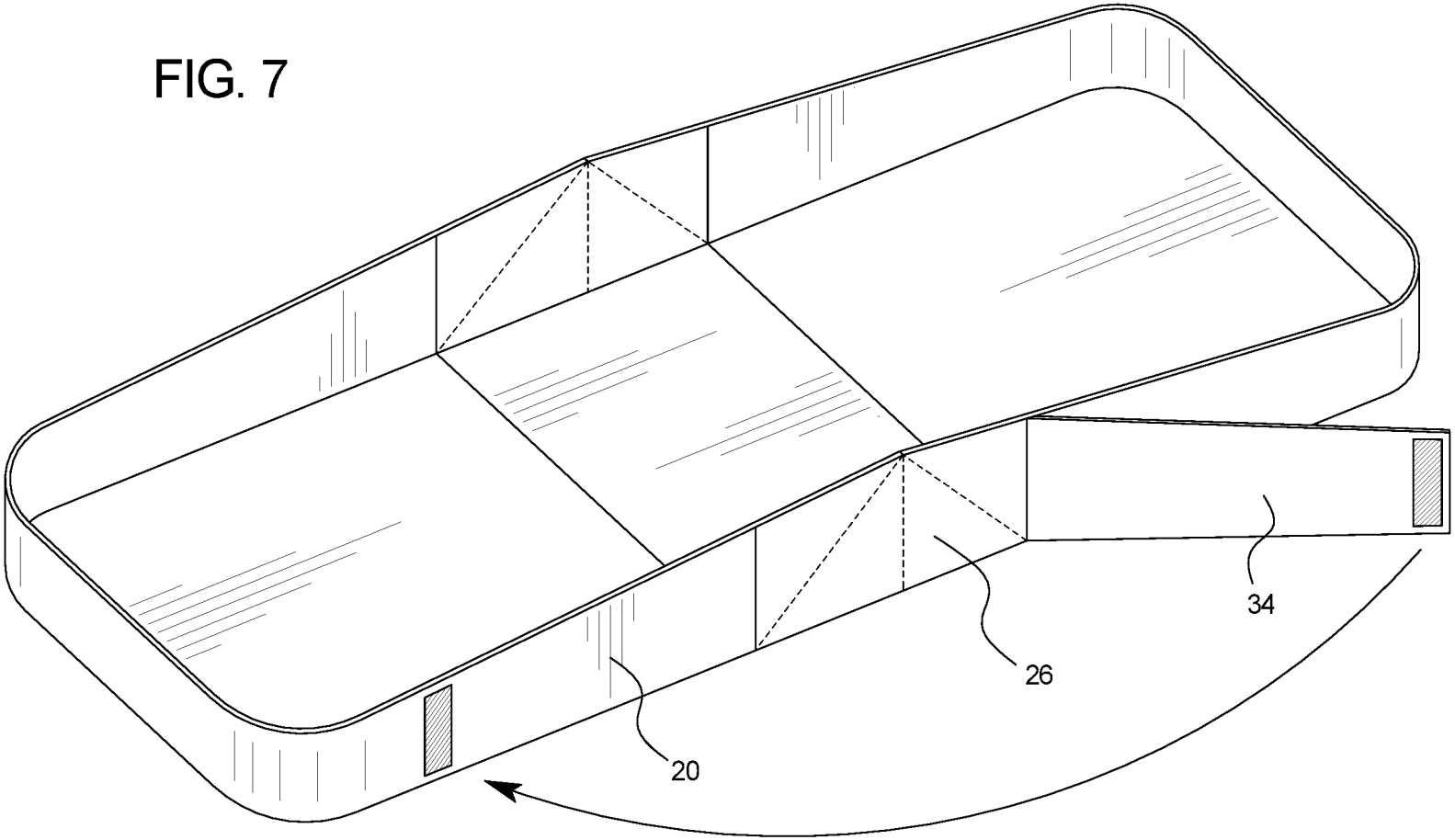
FIG. 7 is a perspective view of another example of a bag including a side wall flap to maintain the structural integrity of the side walls when the bag is in in the open form, wherein the side wall flap is attached across an external surface of the side wall.

As shown in FIG. 4, the bag 10 may also include a side wall flap 34 that extends from the first panel side wall 20 to the second panel side wall 21, wherein the side wall flap 34 covers at least a portion of an inner surface of the center panel side wall 25. In an example, the side wall flap 34 may completely cover the center panel side wall 25. Alternatively, as shown in FIG. 7, the side wall flap 34 may extend from the first panel side wall 20 to the second panel side wall 21, wherein the side wall flap 34 covers at least a portion of an outer surface of the center panel side wall 25. The side wall flap 34 provides structural integrity to the flexible center panel side wall 25 when the bag is in the open form 14. As a result, when a baby is placed on the changing surface 15, the side wall flap 34 prevents the changing surface 15 from buckling under the weight of the baby.

The side wall flap 34 may include a side wall flap first end 42 and a side wall flap second end 44, wherein the side wall first end 42 is connected to the first panel side wall 20. When the bag 10 is in the closed form 12, the side wall flap second end 44 may be removeably attached to the first panel side wall 20. When the bag 10 is in the open form 14, the side wall flap second end 44 may be removeably attached to the second panel side wall 21. As shown in FIG. 4, the side wall flap 34 may removeably attach to and from side wall flap fasteners 36. In an example, the side wall flap fasteners 36 includes a hook and loop fastening system.

In an example, the bag 10 may include a center tray flap 38, wherein the center tray flap 38 includes a center tray flap first end 46 and a center tray flap second end 48, wherein the center tray first end 46 is connected to the first tray panel 16. When the bag 10 is in the closed form 12, the center tray flap second end 48 may be removably attached to the first tray panel 16. When the bag 10 is in the open form 14, the center tray flap second end 48 may be removably attached to the second tray panel 18. The center tray flap 38 may removeably attach to center tray flap fasteners 40 on the first tray panel 16 and the second tray panel 18. The center tray flap fasteners 40 may include a hook and loop fastening system. The center tray flap 38 may cover a portion or all of the center tray panel 24. The center tray flap 38 include rigid material to provide structural integrity to the changing surface 15 to prevent buckling of the changing surface 15 from the weight of a baby.

Figure 6:
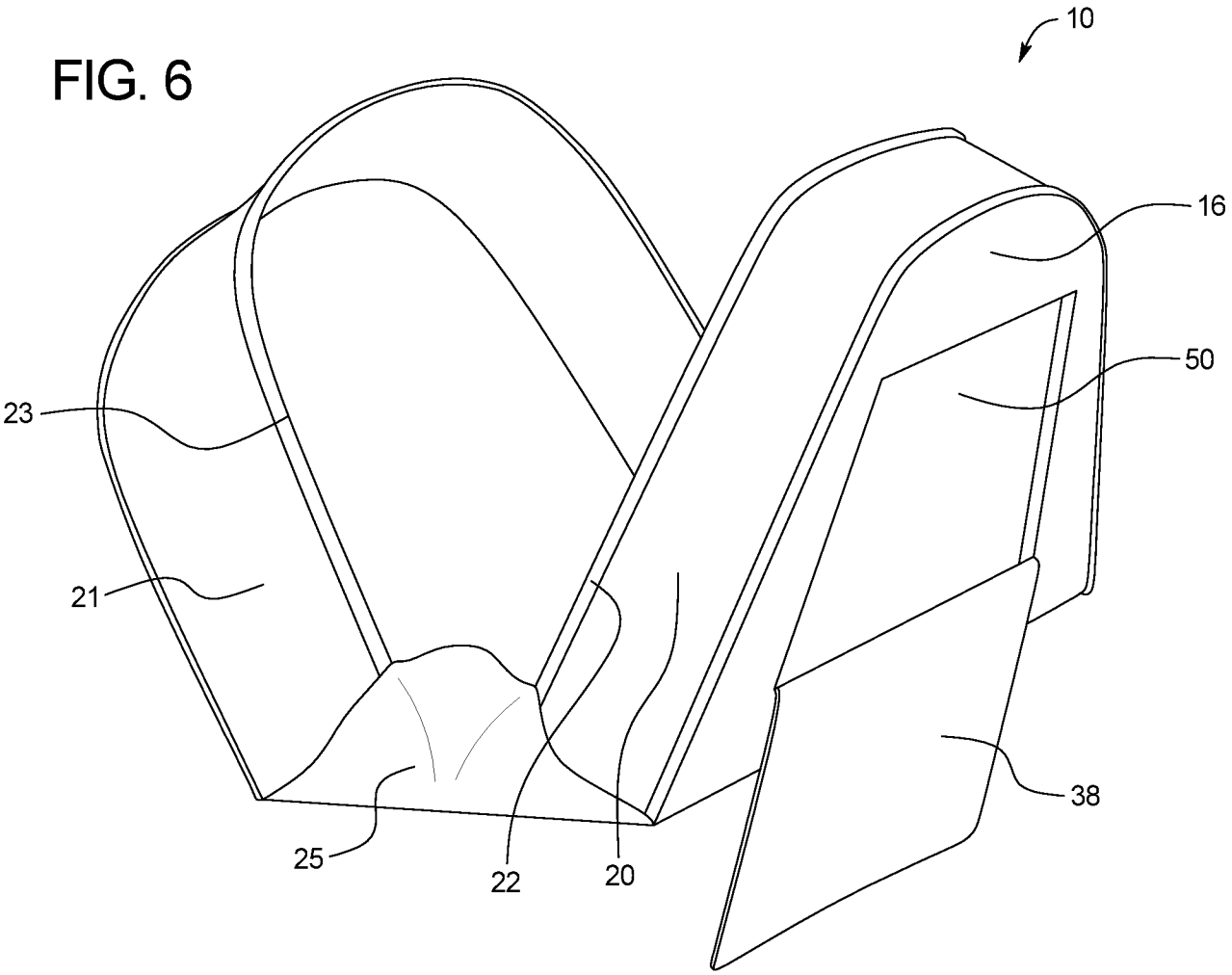
FIG. 6 is the perspective view of an example of the bag wherein the center tray flap is stored within or on the first or second tray panel.

In another example, when the bag 10 is in the closed form 12, the center tray flap 24 is stored within a pocket 50 on an outer surface of the first tray panel 16, as shown in FIG. 6. In such example, when the bag 10 is in the open form 14, the center tray flap 38 may slide from the pocket 50 to removeably attach to the second tray panel 18.

The bag 10 may also include a center strap 28 as shown in FIG. 3. The center strap may connect to opposite sides of the center tray panel 24. Alternatively, the center strap 28 may attach to opposite sides of the center panel side wall 25, such that the center strap extends across the width of the changing surface 15. The center strap 28 may include a clasp that may join a first portion of the center strap 28 to a second portion of the center strap 28. As a result, the center strap 18 may strap a baby to the changing surface 15 such that the baby is safely secured to the changing surface 15, further preventing the baby from rolling off the changing surface 15. The bag 10 may include more than one center strap 28 to further secure the baby to the changing surface 15. For example, two center straps 18 may be used that criss-cross each other to secure the baby to the changing surface 15.

The bag 10 may also include a shoulder strap 30 including a first strap end 52 and a second strap end 54, wherein the first strap end 52 is removeably connected to the first panel side wall 20, wherein the second strap end 54 is removeably attached to the second panel side wall 21. In another example, the shoulder strap 30 may attach to a first side of the first panel side wall 20 and a second side of the first panel side wall 20. In an example, the bag 10 may include a plurality of D-rings 62 along the surface of the first panel side wall 20 and the second panel side wall 21 that the shoulder strap 30 may attach. The shoulder strap 30 in the closed form 12 may attach a first side 60 of the bag 10 to a second side 61 of the bag in a closed form 10, as shown in FIG. 1. The shoulder strap 30 may be detached and reattached such that the shoulder strap 10 attach to the first panel side wall 20 and the second panel side wall 21 when the bag is in the open form 14, as shown in FIG. 4. In such example, the shoulder strap 30 may wrap around the adult's waist to secure the bag 10 to the adult so that the changing surface 15 does not slide off the adult's lap during a diaper change.

The bag 10 may also include at least one hanging compartment 32 including a compartment top edge 56, as shown in FIG. 2. A portion of the compartment top edge 56 is attached to the first panel side wall 20, wherein the hanging compartment 32 is configured to pivot about the portion of the compartment top edge 56 attached to the first panel side wall 20. When the bag 10 is in the closed form 12, the hanging compartment 32 may hang along an internal surface of the first panel side wall 20. When the bag is in the open form 14, the hanging compartment 32 may hang along an external surface of the first panel side wall 20.

It should be noted that various changes and modifications to the embodiments described herein will be apparent to those skilled in the art. Such changes and modifications may be made without departing from the spirit and scope of the present invention and without diminishing its attendant advantages. For example, various embodiments of the bag may be provided based on various combinations of the features and functions from the subject matter provided herein.

We claim:

1. A method of using a convertible bag comprising:

providing the convertible bag, wherein the convertible bag comprises:

a changing surface including a first tray panel and a second tray panel, wherein the first tray panel is connected to the second tray panel;

a first panel side wall extending perpendicular from the first tray panel along the perimeter of the first tray panel, wherein the first panel side wall includes a first top edge; and a second panel side wall extending perpendicular from the second tray panel along the perimeter of the second tray panel, wherein the second panel side wall includes a second top edge;

a shoulder strap including a first strap end and a second strap end, wherein each of the first and second strap ends is removably attached to the bag; and a plurality of connection points for removably attaching the first and second strap ends to the bag;

wherein the convertible bag moves between a closed position and an open position;

wherein, when the convertible bag is in the closed position, the first tray panel and the second tray panel are parallel, the first panel side wall and the second panel side wall define a top surface, a first side wall, and a second side wall of the bag; and wherein, when the bag is in the open position, the first and second tray panels are within a plane; and wherein the plurality of connection points includes at least two connection points located so the shoulder strap can be attached to span the first and second side walls when the bag is in the closed position and at least two connection points located so the shoulder strap can be attached to span a single side wall when the bag is in the open position;

placing the bag in the open position on a lap of a person;

disconnecting the first strap end of the shoulder strap from the bag;

wrapping the shoulder strap around a waist of the person; and connecting the first strap end of the shoulder strap to the bag so that the shoulder strap spans a single side wall.

2. The method of claim 1, wherein the bag includes first and second gussets between the first and second panel side walls.

3. The method of claim 1, wherein the bag further comprises a center tray flap including a center tray flap first end and a center tray flap second end, wherein the center tray flap first end is connected to the first tray panel, and wherein the method further comprises the steps of:

detaching the center tray flap first end from the first tray panel; and attaching the center tray flap first end to the second tray panel when the bag is in the open position.

4. The method of claim 1, wherein the bag further comprises at least one hanging compartment including a compartment top edge, wherein a portion of the compartment top edge is attached to the first panel side wall.

5. The method of claim 4 further comprising the step of pivoting the hanging compartment about the portion of the compartment top edge attached to the first panel side wall, wherein, when the bag is in the closed position, the hanging compartment hangs along an internal surface of the first panel side wall, wherein, when the bag is in the open position, the hanging compartment hangs along an external surface of the first panel side wall.

* * * * *